US010446986B2

(12) United States Patent
Zhong et al.

(10) Patent No.: US 10,446,986 B2
(45) Date of Patent: Oct. 15, 2019

(54) ELECTRICAL CONNECTOR WITH ADDITIONAL SHIELDING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Wei Zhong, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/228,659

(22) Filed: Dec. 20, 2018

(65) Prior Publication Data

US 2019/0190210 A1 Jun. 20, 2019

(30) Foreign Application Priority Data

Dec. 20, 2017 (CN) ..... 2017 1 1383071

(51) Int. Cl.
*H01R 13/6585* (2011.01)
*H01R 13/405* (2006.01)
(Continued)

(52) U.S. Cl.
CPC ..... *H01R 13/6585* (2013.01); *H01R 13/405* (2013.01); *H01R 13/6582* (2013.01);
(Continued)

(58) Field of Classification Search
CPC ..... H01R 13/6585; H01R 13/6582; H01R 13/6596; H01R 13/405; H01R 43/02
See application file for complete search history.

(56) References Cited

U.S. PATENT DOCUMENTS 7,261,598 B1 * 8/2007 Tseng ..... H01R 13/6582 439/607.36
7,601,029 B2 * 10/2009 Horiuchi ..... H01R 4/20 439/497
(Continued)

FOREIGN PATENT DOCUMENTS

CN 201562838 U 8/2010
CN 104425995 B 1/2017
(Continued)

*Primary Examiner* — Briggitte R. Hammond
(74) *Attorney, Agent, or Firm* — Wei Te Chung; Ming Chieh Chang

(57) ABSTRACT

A electrical connector includes an insulative elongated housing and first and second metallic shells covering the housing. The housing includes a top surface, a bottom surface, two sides surfaces and a middle surface between the top surface and the bottom surface so as to form a step structure thereof. The primary shell covers the top surface, the bottom surface and two side surfaces, and the secondary shell covers the middle surface and the rear surface which is roughly joined with the middle surface, and further the primary shell on the bottom surface in an overlapped manner so as to avoid any electrical leaking along the front-to-back direction between the primary shell and the secondary shell.

15 Claims, 12 Drawing Sheets

(51) Int. Cl.

| | |
|---|---|
| ***H01R 13/6596*** | (2011.01) |
| ***H01R 13/6582*** | (2011.01) |
| ***H01R 43/02*** | (2006.01) |
| ***H01R 43/24*** | (2006.01) |
| ***H01R 13/6593*** | (2011.01) |

(52) U.S. Cl.
CPC ..... *H01R 13/6593* (2013.01); *H01R 13/6596* (2013.01); *H01R 43/02* (2013.01); *H01R 43/24* (2013.01)

(56) References Cited

U.S. PATENT DOCUMENTS

| | | | | | |
|---|---|---|---|---|---|
| 7,699,655 | B2 * | 4/2010 | Wang | H01R 12/57 | 439/607.33 |
| 7,736,172 | B2 * | 6/2010 | Yang | H01R 13/6275 | 439/358 |
| 7,794,271 | B2 * | 9/2010 | Wu | H01R 12/598 | 439/497 |
| 7,914,322 | B2 * | 3/2011 | Lin | H01R 4/023 | 439/497 |
| 8,172,616 | B2 * | 5/2012 | Miyazaki | H01R 12/592 | 439/607.55 |
| 8,241,065 | B2 * | 8/2012 | Ikari | H01R 12/775 | 439/372 |
| 8,287,311 | B2 * | 10/2012 | Lin | H01R 9/05 | 439/607.55 |
| 8,337,249 | B2 * | 12/2012 | Lappoehn | H01R 13/6585 | 439/607.55 |
| 8,597,051 | B2 * | 12/2013 | Yang | H01R 12/57 | 439/589 |
| 8,740,649 | B2 * | 6/2014 | Lan | H01R 13/506 | 439/607.4 |
| 9,208,922 | B2 * | 12/2015 | Yoshida | H01B 1/02 | |
| 9,647,395 | B2 * | 5/2017 | Hsu | H01R 13/405 | |
| 9,780,468 | B2 * | 10/2017 | Yokoyama | H01R 12/7047 | |
| 10,128,618 | B1 * | 11/2018 | Briant | H01R 13/6581 | |
| 10,153,594 | B2 * | 12/2018 | Wu | H01R 12/775 | |
| 10,297,955 | B2 * | 5/2019 | Zhu | H01R 13/6581 | |
| 2003/0176111 | A1 * | 9/2003 | Iida | H01R 12/592 | 439/660 |
| 2009/0029601 | A1 * | 1/2009 | Yamaji | H01R 12/592 | 439/694 |

FOREIGN PATENT DOCUMENTS

| | | |
|---|---|---|
| CN | 106410517 A | 2/2017 |
| CN | 206004086 U | 3/2017 |

* cited by examiner

ELECTRICAL CONNECTOR WITH ADDITIONAL SHIELDING

1. FIELD OF THE INVENTION

The invention relates to the electrical connector, and particularly to an electrical connector with complete shielding.

2. DESCRIPTION OF RELATED ART

U.S. Pat. No. 9,647,395 discloses an electrical receptacle connector having an insulative housing in a stepped configuration with a frame like metallic primary shell enclosing opposite top and bottom surfaces and two opposite sides surfaces of the housing, and further an L-shaped metallic secondary shell covering the rear stepped structure. Anyhow, a tiny gap may exist between a boundary between the primary shell and the secondary shell, thus resulting in electrical leaking. Understandably, ideally a unitary one piece metallic shell enclosing all surfaces of the housing may have the superior shielding effect. Anyhow, because the housing is not a simple rectangular block, it is not easy to design a one piece unitary metallic shell to cover all the surfaces of the irregularly shaped housing under easy manufacturing and material saving requirements. In addition, the grounding bar used in the connector may not be reliably constantly connected to the metallic shell, thus jeopardizing the whole grounding/shielding effect thereof.

It is desired to have the electrical connector having corresponding metallic shell structure with reliable shielding effect.

SUMMARY OF THE INVENTION

An object of the invention is to provide an electrical connector with an insulative elongated housing and first and second metallic shells covering the housing. The housing includes a top surface, a bottom surface, two sides surfaces and a middle surface between the top surface and the bottom surface so as to form a step structure thereof. The primary shell covers the top surface, the bottom surface and two side surfaces, and the secondary shell covers the middle surface and the rear surface and further the primary shell on the bottom surface in an overlapped manner so as to avoid any electrical leaking along the front-to-back direction between the primary shell and the secondary shell.

Other objects, advantages and novel features of the invention will become more apparent from the following detailed description when taken in conjunction with the accompanying drawings.

DETAILED DESCRIPTION OF THE PREFERRED EMBODIMENT

Figure 1:
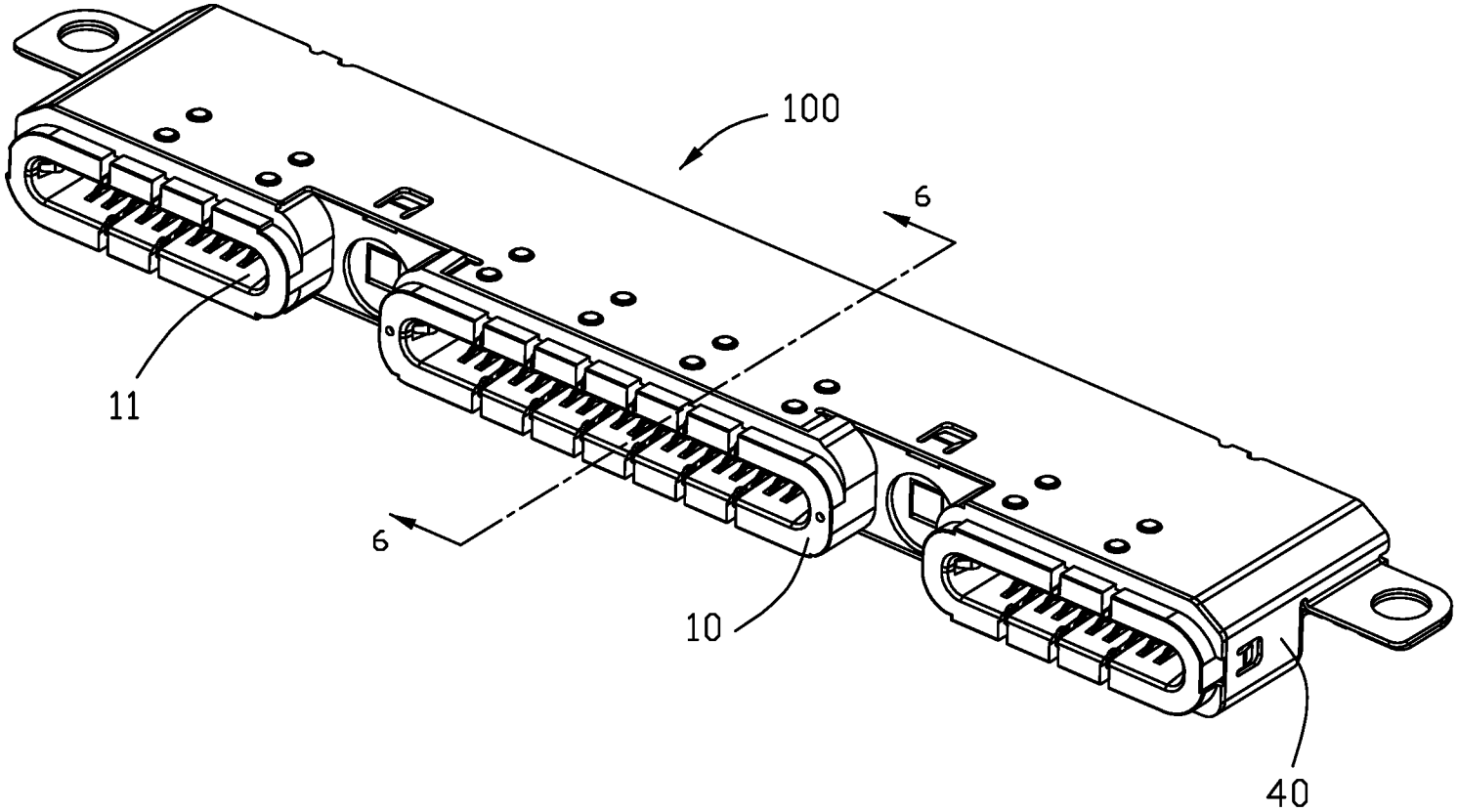
FIG. 1 is a perspective view of an electrical connector of the first preferred embodiment of the invention.
Figure 2:
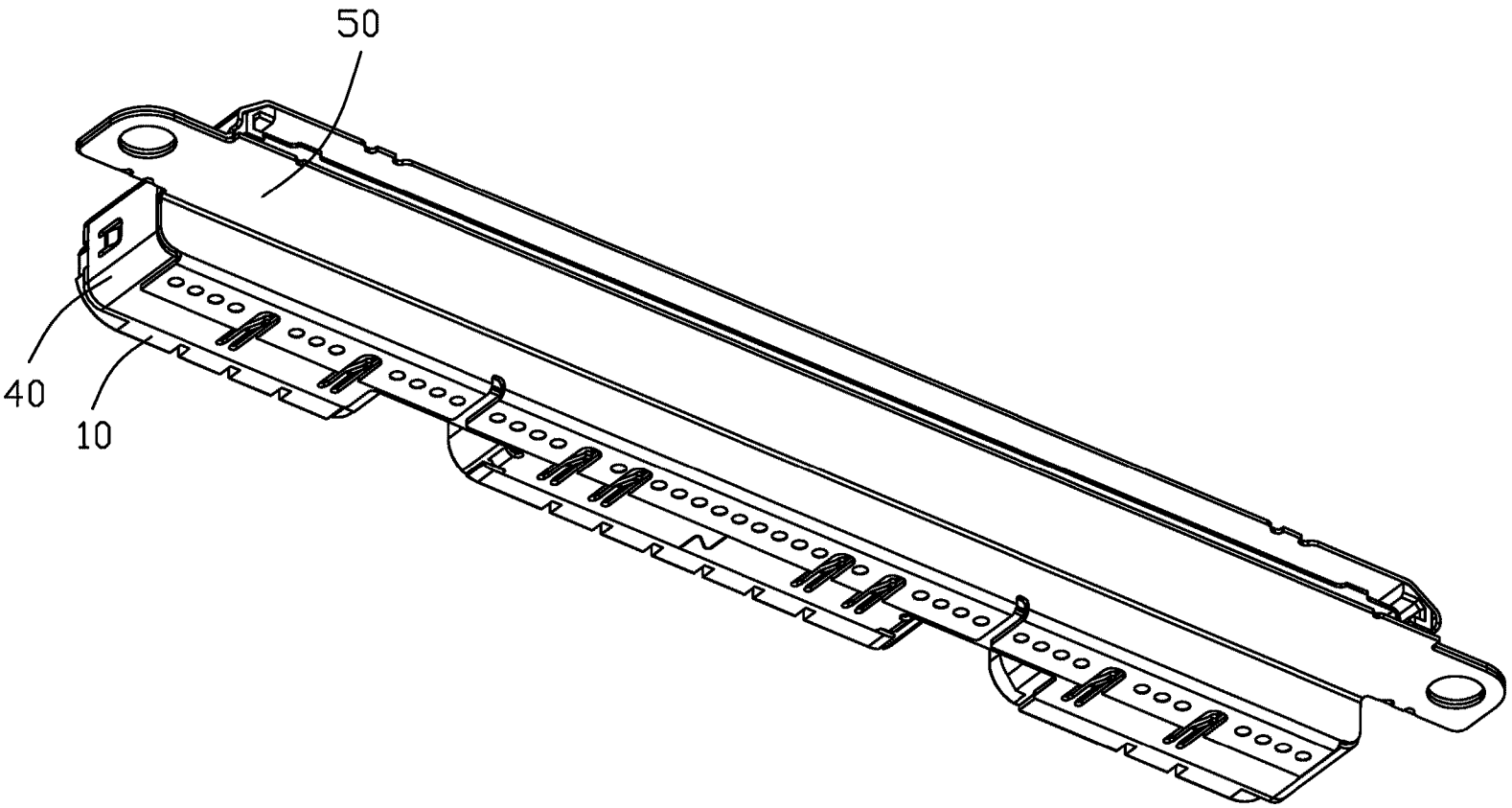
FIG. 2 is another perspective view of the electrical connector of FIG. 1.
Figure 3:
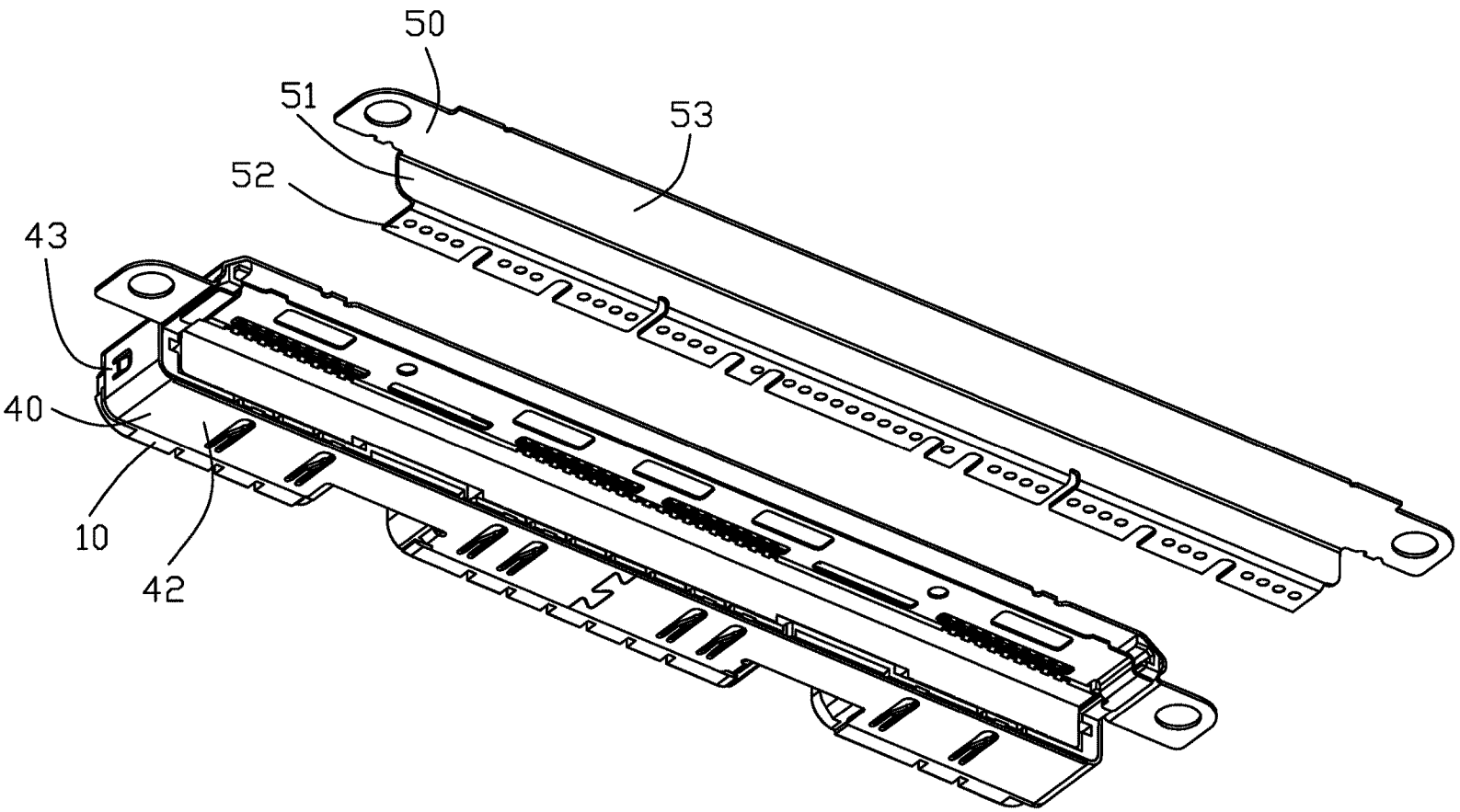
FIG. 3 is an exploded perspective view of the electrical connector of FIG. 1.
Figure 4:
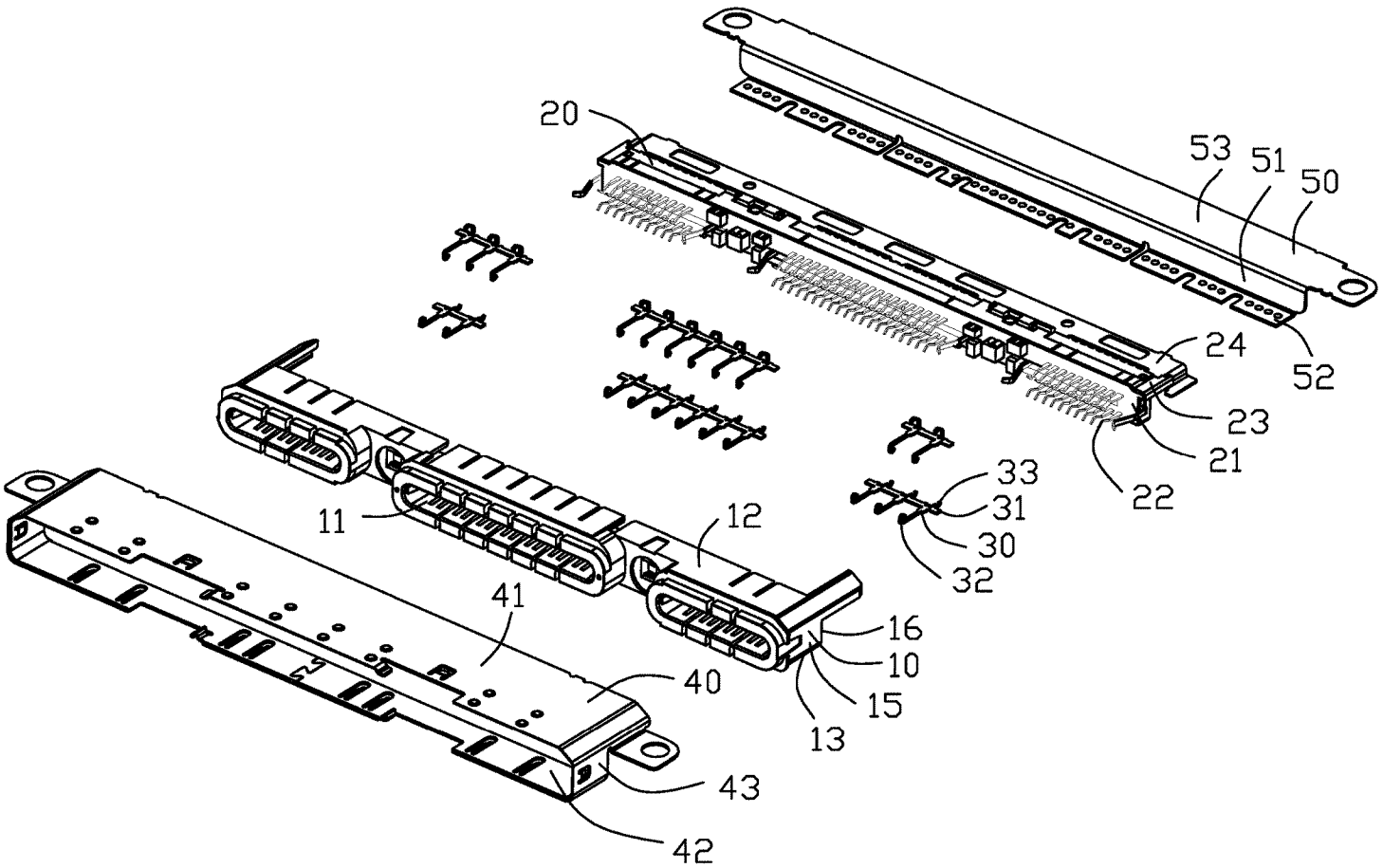
FIG. 4 is a further exploded perspective view of the electrical connector of FIG. 3.
Figure 5:
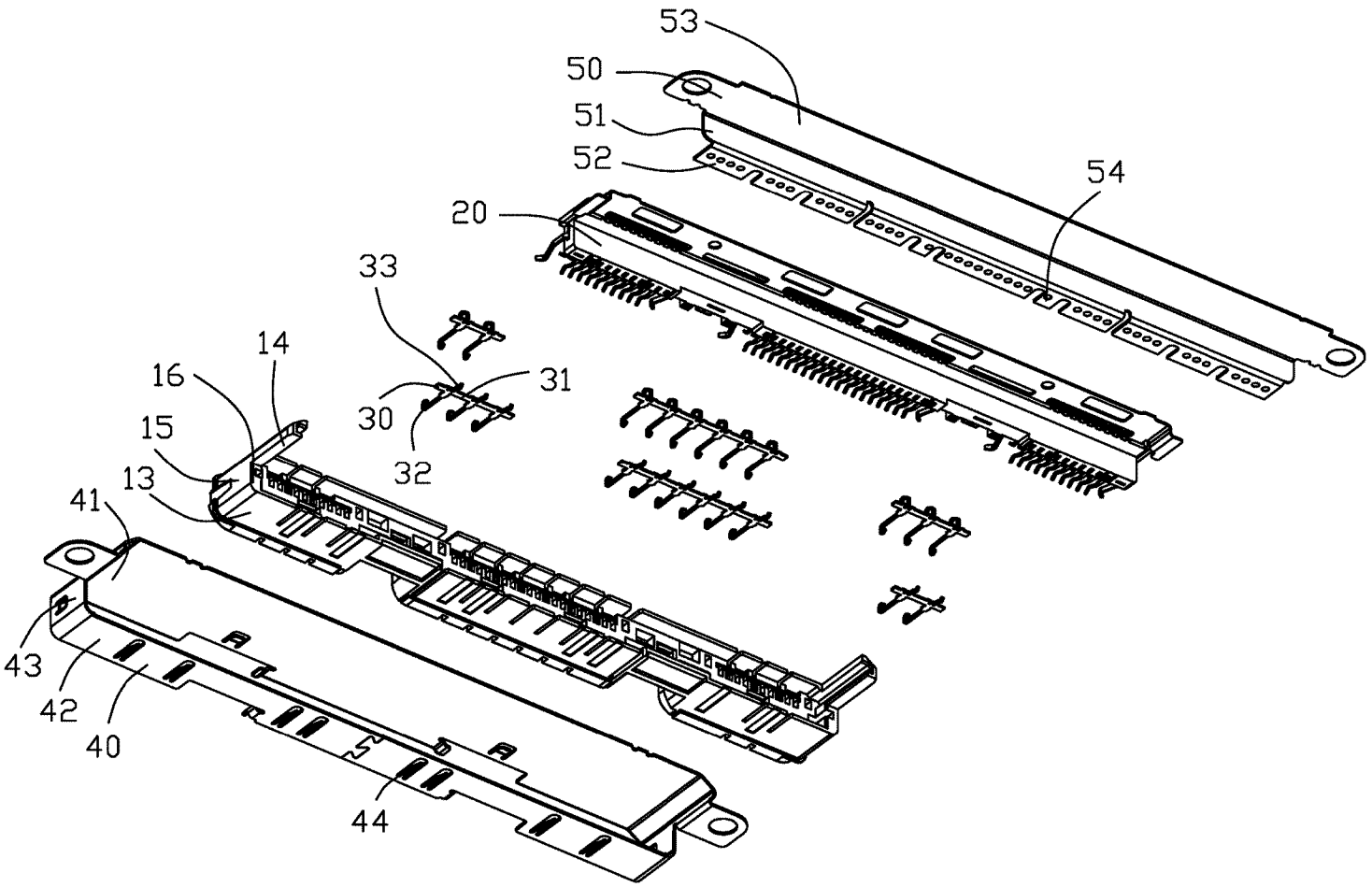
FIG. 5 is another further exploded perspective view of the electrical connector of FIG. 4.
Figure 6:
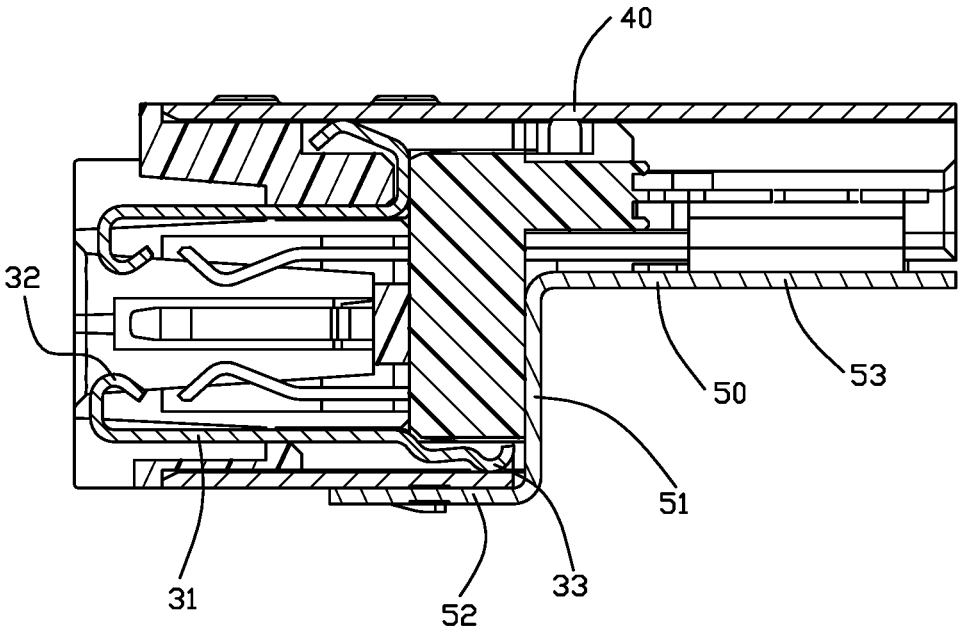
FIG. 6 is cross-sectional view of the electrical connector of FIG. 1.

Referring to FIGS. 1-6, an electrical connector 100 includes an insulative elongated housing 10 extending along a longitudinal direction, a contact module 20 assembled to the housing 10, a plurality of grounding members 30 assembled upon the housing 10, and a metallic shielding unit composed of a primary shell 40 and a secondary shell 50. The contact module 20 includes a first insulator 21, a plurality of contacts 22 integrally formed with the first insulator 21, a second insulator 23 over-molded upon the first insulator 21, and an inner shielding plate 24 integrally formed with the second insulator 23. In fact, because there are two rows of contacts 22, there are two pieces of the first insulator 21 respectively integrally formed with the corresponding rows of contacts, respectively, via an insert-molding process. The contact module 20 is forwardly assembled into the housing 10 from a rear side of the housing 10. The housing 10 forms three mating ports 11 rearwardly recessed from a front surface (not labeled) of the housing on a front side. The grounding member 30 includes a base 31, a plurality of mating sections 32 forwardly extending therefrom into the mating port 11, and a plurality of connecting sections 33 extending rearwardly therefrom to contact the primary shell 40. In this embodiment, as shown in FIG. 6 the connecting section 33 of the upper grounding member 30 is tightly sandwiched between the housing 10 and the insulator of the contact module 20 in the front-to-back direction, and further deflectably and resiliently sandwiched between the housing 10 and the primary shell 40 in the vertical direction perpendicular to the front-to-back direction, while the connecting section 33 of the lower grounding member 30 cooperates with the additional section 52 of the secondary shell 50 to sandwich the lower wall 42 of the primary shell 40 both of which will be illustrated later. The housing 10 includes opposite top surface 12 and bottom surface 13 in a vertical direction perpendicular to the longitudinal direction, a middle downward surface 14 which is formed on each rearwardly extending side arm (not labeled) and located between the top surface 12 and the bottom surface 13 in the vertical direction, a pair of side surfaces 15 in the longitudinal direction, and a vertical rear/rearward surface 16 joined with the middle surface 14 and facing rearwardly in a front-to-back direction perpendicular to both the vertical direction and the longitudinal direction. The primary shell 40 has a frame configuration with an upper wall 41, a lower wall 42 and two side walls 43 to respectively cover the corresponding top surface 12, the bottom surface 13 and two side surfaces 15. The secondary shell 50 of a Z-shaped cross-section, includes a first section 51 to cover the rearward surface 16, a second section 53 to cover the middle surface 14, and further an additional section 52 forwardly extending from a bottom edge of the first section 51 to be welded upon the lower wall 42 in an overlapped manner. Notably, both the primary shell 40 and the secondary shell 50 have the corresponding mounting ears (not labeled) at two longitudinal ends around the middle surface 14 for securing. The additional section 52 forms a plurality of cutouts 54 to allow extension of the outwardly extending spring tangs 44 to outwardly protrude therethrough. Notably, as shown in FIG. 6 even though a space is formed around the connecting section 33, the EMI (Electro-Magnetic Interference) leading along the front-to-back direction thereabouts may be avoided due to continuous extension between the first section 51 and the additional section 52 around the corresponding joined corner between the bottom surface 13 and the rearward surface 16. In opposite, in the aforementioned U.S. Pat. No. 9,647,395 the possible EMI leaking along the front-to-back direction may exist due to lacking the additional section of the secondary shell overlapping with the lower wall of the primary shell.

Figure 7:
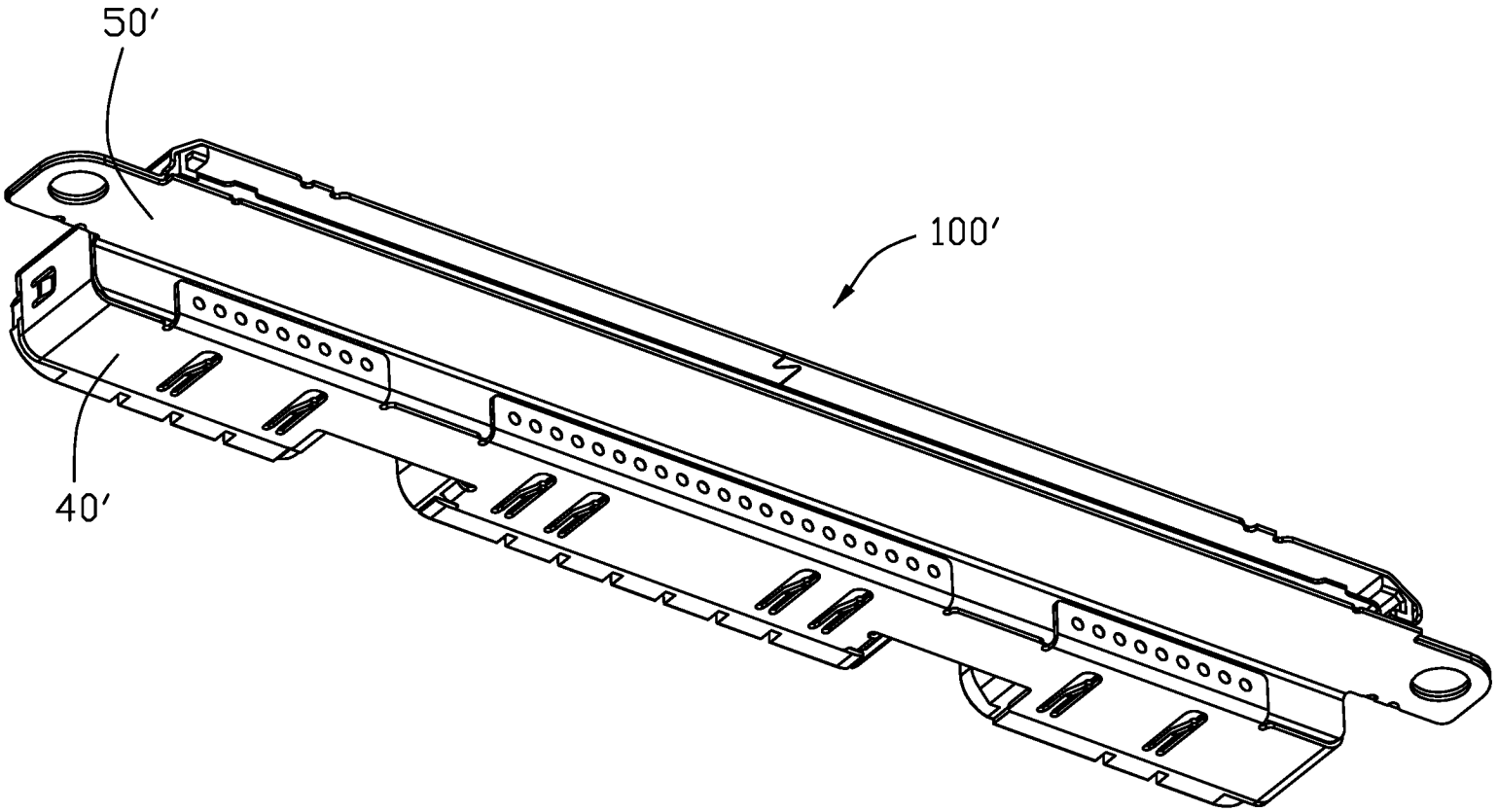
FIG. 7 is a perspective view of an electrical connector of the second embody of the invention.
Figure 8:
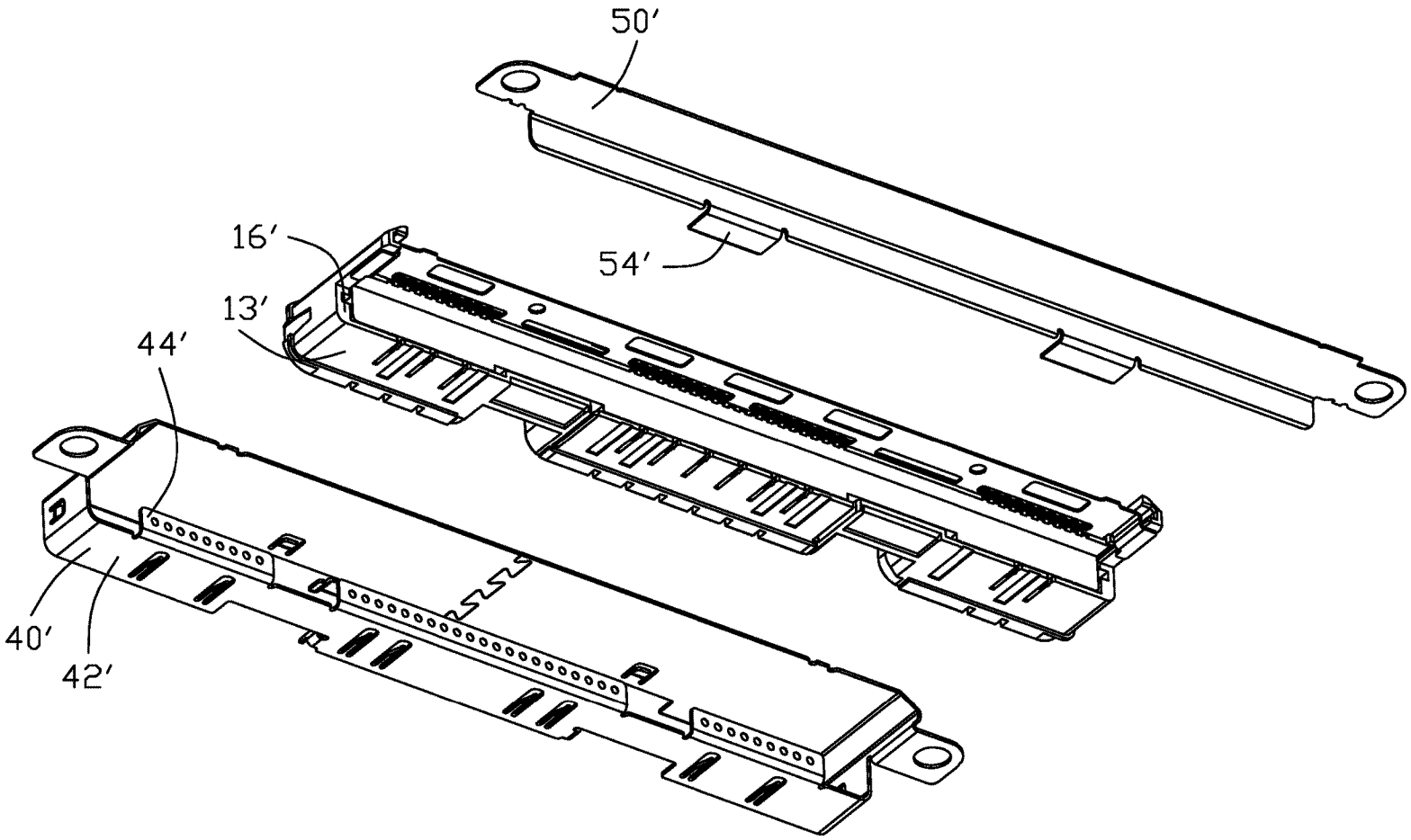
FIG. 8 is an exploded perspective view of the electrical connector of FIG. 7.

Referring to FIGS. 7 and 8, in the connector 100' on one hand the first shell 40' further includes a plurality of vertical addition sections 44' extending upwardly from a rear edge of the lower wall 42' to be welded behind the vertical first section (not labeled) of the secondary shell 50'. On the other hand, in the secondary shell 50 the additional section 54' is arranged to be alternate with the additional sections 44' in the longitudinal direction. The additional section 54' is received within a shallow recess (not labeled) in the bottom surface 13', and the lower wall 42' cooperates with the bottom surface 13' to sandwich there additional section 54 therebetween in the vertical direction. Notably, similar to the additional section 54', the additional sections 44 may prevent EMI leaking around the corner between the bottom surfaced 13' and the rearward surface 16' along the front-to-back direction.

Figure 9:
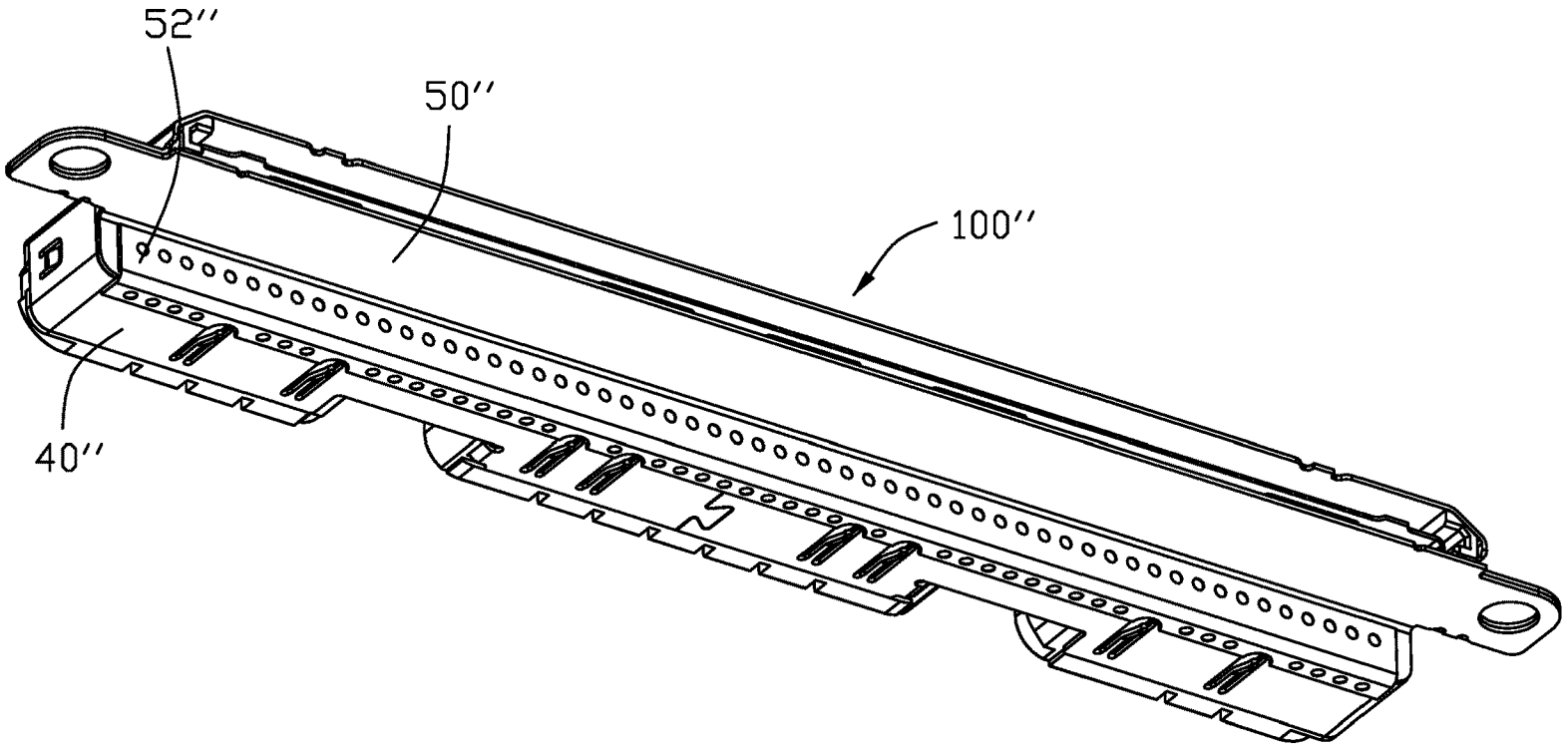
FIG. 9 is a perspective view of an electrical connector of a third embodiment of the invention.
Figure 10:
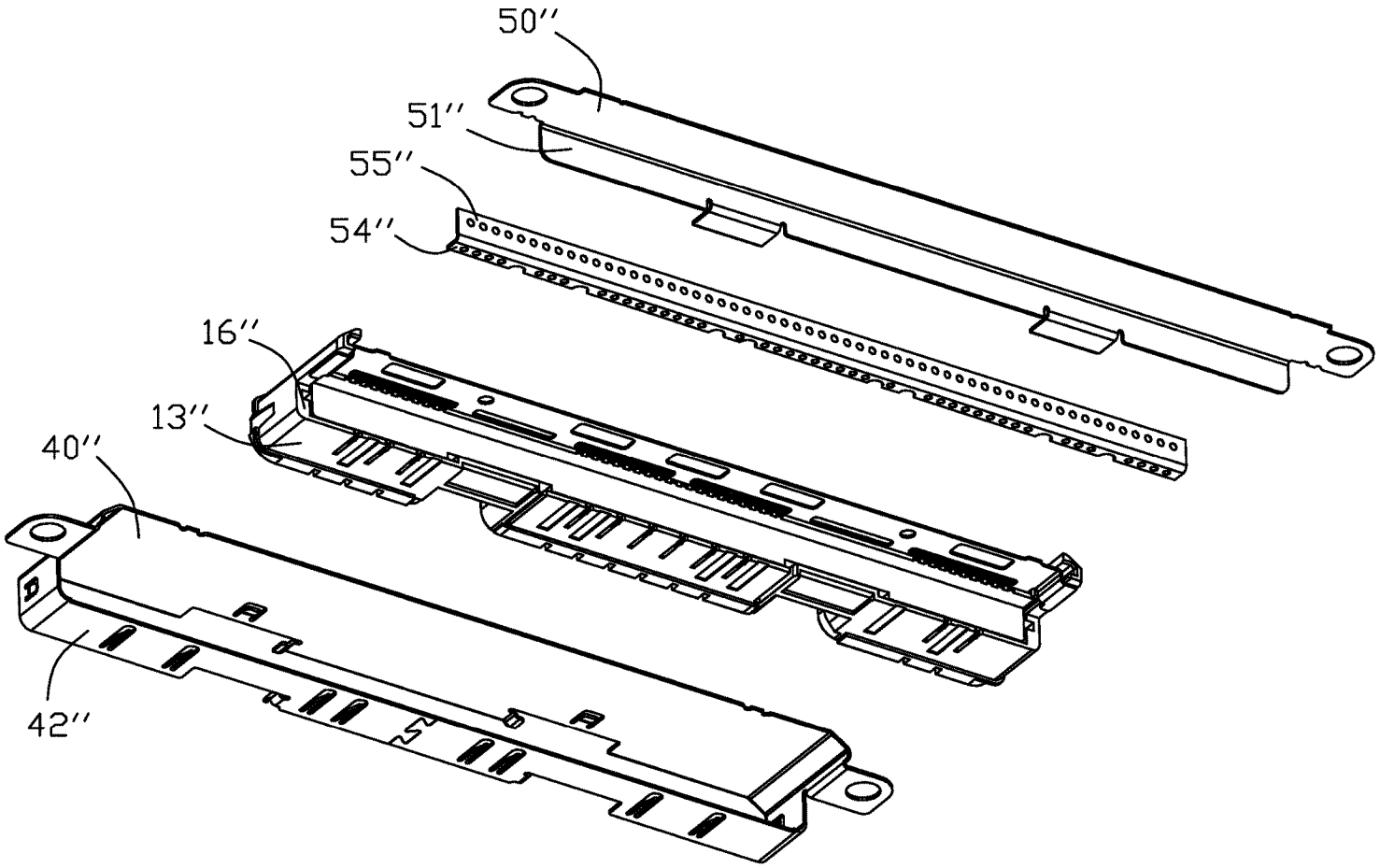
FIG. 10 is an exploded perspective view of the electrical connector of FIG. 9.

Referring to FIGS. 9 and 10, in the connector 100" a discrete addition piece 52", either a metal plate or a conductive glue layer, is located behind and second shell 50" and under the primary shell 40". The L-shaped addition piece 52" includes a first section 54" welded on and located below the lower wall 42" in the vertical direction, and a second section 55" welded on and located behind the first section 51" of the secondary shell 50" in the front-to-back direction so as to seal any possible leak around the corner of the bottom surface 13" and the rearward surface 16".

Figure 11:
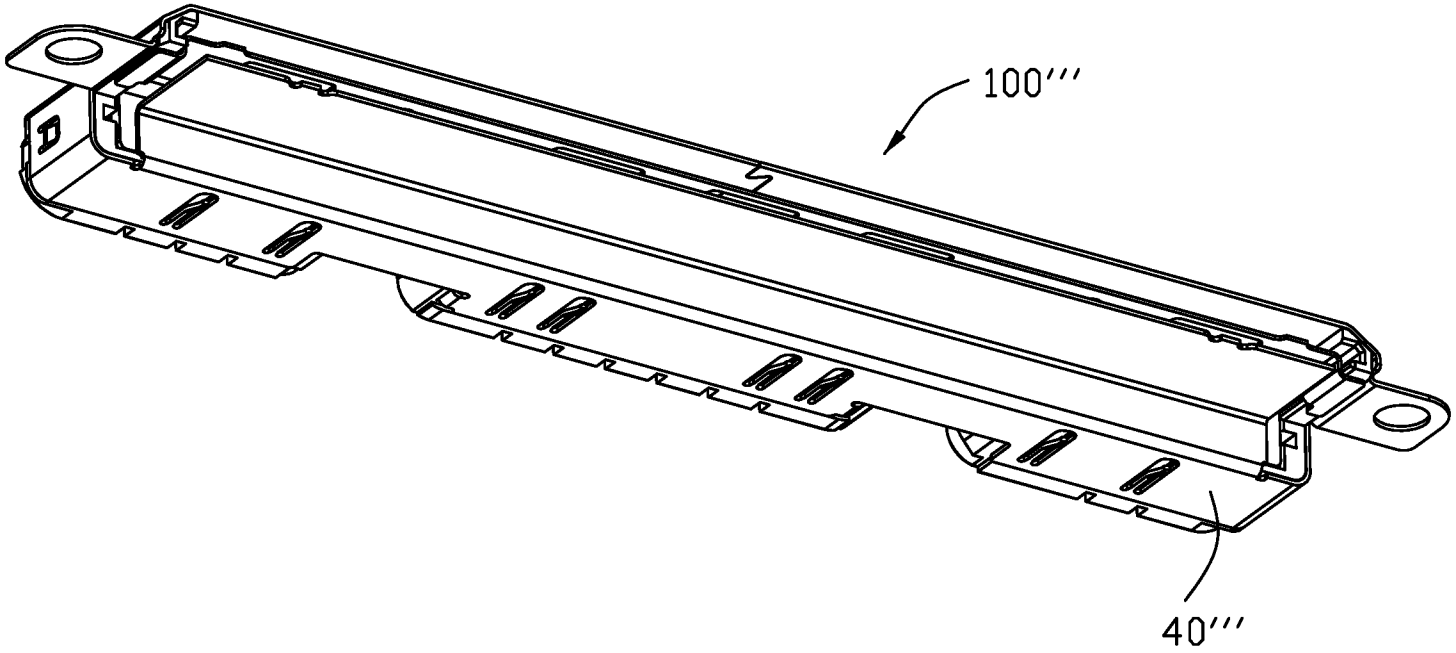
FIG. 11 is a perspective view of an electrical connector of a fourth embodiment of the invention.
Figure 12:
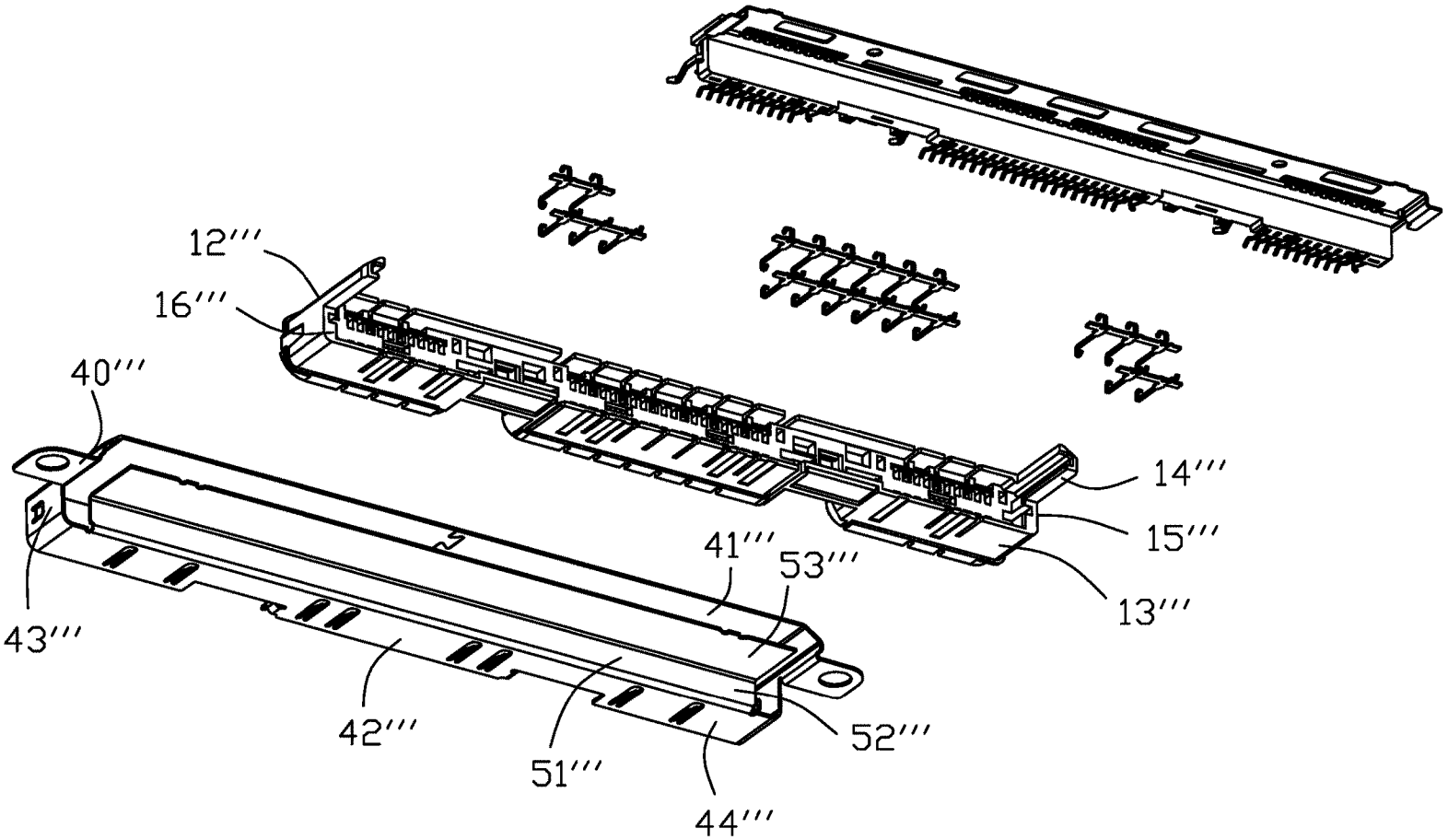
FIG. 12 is an exploded perspective view of the electrical connector of FIG. 11.

Referring to FIGS. 11 and 12, in the connector 100''', the primary shell 40" includes a main part 44''' and an additional part 52'''. The main part 44''' includes an upper wall 41''', a lower wall 42''' and a pair of side walls 43'''. The addition part 52''' includes a first section 51''' extending upwardly from a rear edge of the lower wall 42", and a second section 53''' extending from an upper edge of the first section 51'''. The upper wall 41''' covers the top surface 12''', the lower wall 42''' covers the bottom surface 13''', the two side walls 43''' cover the side surfaces 15'''. The first section 51''' covers the rear surface 16''', and the second section 53''' covers the middle surface 14'''. Understandably, because of the unitary one piece structure of the primary shell 40''' around the corner between the rearward surface 16''' and the bottom surface 13''', the shielding effect is reliable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a contact module including a plurality contacts retained in an insulator;

an insulative elongated housing, in which the contact module is received, extending along a longitudinal direction to define opposite top and bottom surfaces in a vertical direction perpendicular to the longitudinal direction, a pair of side surfaces along the longitudinal direction, and opposite front and rear surfaces in a front-to-back direction perpendicular to both the longitudinal direction and the vertical direction, said housing further defining a horizontal rear middle surface between the top surface and the bottom surface in the vertical direction and a vertical rearward surface roughly joined with the middle surface and rearwardly facing in the front-to-back direction;

a metallic shielding unit including:

a one piece primary shell being of a frame structure and forming a top wall covering the top surface, a lower wall covering a bottom surface, a pair of side walls covering the pair of side surfaces; and a one piece Z-shaped secondary shell forming a vertical first section covering the rearward surface, a horizontal second section extending from an upper edge of the first section to cover the middle surface, and further an addition section extending from a lower edge of the first section to be located below and welded to the lower wall so as to prevent any EMI (Electro-Magnetic Interference) leakage, in the front-to-back direction, between the primary shell and the secondary shell around a corner between the bottom surface and the rearward surface of the housing.

2. The electrical connector as claimed in claim 1, wherein the lower wall forms a plurality of outwardly extending spring tangs, and the additional section forms a plurality of cutouts to allow said spring tangs to protrude outwardly therethrough.

3. The electrical connector as claimed in claim 1, further including a plurality of conductive grounding members assembled upon the housing with connecting sections deflectably mechanically and electrically contact the primary shell in the vertical direction.

4. The electrical connector as claimed in claim 3, wherein said connecting sections are further sandwiched between the housing and the insulator of the contact module in the front-to-back direction.

5. The electrical connector as claimed in claim 3, wherein the lower wall is sandwiched between the additional section of the secondary shell and the connecting section of the grounding member.

6. An electrical connector comprising:

a contact module including a plurality contacts retained in an insulator;

an insulative elongated housing, in which the contact module is received, extending along a longitudinal direction to define opposite top and bottom surfaces in a vertical direction perpendicular to the longitudinal direction, a pair of side surfaces along the longitudinal direction, and opposite front and rear surfaces in a front-to-back direction perpendicular to both the longitudinal direction and the vertical direction, said housing further defining a horizontal rear middle surface between the top surface and the bottom surface in the vertical direction and a vertical rearward surface roughly joined with the middle surface and rearwardly facing in the front-to-back direction;

a metallic shielding unit including:

a primary shell being of a frame structure and forming a top wall covering the top surface, a lower wall covering a bottom surface, a pair of side walls covering the pair of side surfaces;

a secondary shell forming a vertical first section covering the rearward surface, a horizontal second section extending from an upper edge of the first section to cover the middle surface; wherein said shielding unit further includes an additional section at least partially overlapped with the lower wall of the primary shell in the vertical direction, and welding is applied to at least two of said primary shell, said secondary shell and the additional sections so as to prevent any EMI (Electro-Magnetic Interference) leakage, in the front-to-back direction, between the primary shell and the secondary shell around a corner between the bottom surface and the rearward surface of the housing.

7. The electrical connector as claimed in claim 6, wherein said additional section unitarily extends from a bottom edge of the first section of the secondary shell.

8. The electrical connector as claimed in claim 7, wherein the additional section of the secondary shell is located under the lower wall of the primary shell with the welding applied therebetween.

9. The electrical connector as claimed in claim 7, wherein the housing forms a recess in the bottom surface to receive the additional section of the secondary shell.

10. The electrical connector as claimed in claim 9, wherein said additional section is sandwiched between the bottom surface of the housing and the lower wall of the primary shell.

11. The electrical connector as claimed in claim 10, wherein said primary shell further includes another additional section extending upwardly from a rear edge of the lower wall to be located behind and forwardly butting against the first section of the secondary shell in the front-to-back direction.

12. The electrical connector as claimed in claim 11, wherein the additional section of the secondary shell and the additional section of the primary shell are offset from each other in the longitudinal direction.

13. The electrical connector as claimed in claim 11, wherein the additional section of the primary shell is welded to the first section of the secondary shell.

14. The electrical connector as claimed in claim 6, wherein said additional section belongs to an L-shaped addition piece discrete from both the primary shell and the secondary shell and having said additional section welded under the lower wall of the primary shell and another additional section unitarily extending from a rear edge of said addition section to be located behind and welded upon the first section of the secondary shell.

15. An electrical connector comprising:

a contact module including a plurality contacts retained in an insulator;

an insulative elongated housing, in which the contact module is received, extending along a longitudinal direction to define opposite top and bottom surfaces in a vertical direction perpendicular to the longitudinal direction, a pair of side surfaces along the longitudinal direction, and opposite front and rear surfaces in a front-to-back direction perpendicular to both the longitudinal direction and the vertical direction, said housing further defining a horizontal rear middle surface between the top surface and the bottom surface in the vertical direction and a vertical rearward surface roughly joined with the middle surface and rearwardly facing in the front-to-back direction;

a metallic shielding unit including:

a primary shell being of a frame structure and forming a top wall covering the top surface, a lower wall covering a bottom surface, a pair of side walls covering the pair of side surfaces; and a secondary shell forming a vertical first section covering the rearward surface, a horizontal second section extending from an upper edge of the first section to cover the middle surface; wherein the vertical first section of the secondary shell unitarily extends from a rear edge of the lower wall of the primary shell so as to prevent any EMI (Electro-Magnetic Interference) leakage, in the front-to-back direction, between the primary shell and the secondary shell around a corner between the bottom surface and the rearward surface of the housing.

* * * * *